United States Patent [19]

Etou et al.

[11] Patent Number: 4,973,232

[45] Date of Patent: Nov. 27, 1990

[54] ROTATING SCROLL MACHINE WITH OIL PUMP

[75] Inventors: Isamu Etou; Kozaburo Fujii; Kiyonori Tokumitsu; Mitsuhiro Nishida, all of Fukuoka, Japan

[73] Assignee: Mitsubishi Denki Kabushiki Kaisha, Tokyo, Japan

[21] Appl. No.: 330,514

[22] Filed: Mar. 30, 1989

[30] Foreign Application Priority Data

Sep. 20, 1988 [JP] Japan ..... 63-236048

[51] Int. Cl.[5] ..... F01C 1/04; F01C 21/04; F04C 27/02

[52] U.S. Cl. ..... 418/55.6; 418/88; 418/94; 418/188

[58] Field of Search ..... 418/55 E, 88, 94, 188

[56] References Cited

U.S. PATENT DOCUMENTS 4,781,550 11/1988 Morishita et al. ..... 418/55 E
4,846,640 7/1989 Nishida et al. ..... 418/55 E
4,898,521 2/1990 Sakurai et al. ..... 418/88

*Primary Examiner*—John J. Vrablik
*Attorney, Agent, or Firm*—Sughrue, Mion, Zinn, Macpeak and Seas

[57] ABSTRACT

A scroll machine comprises a pair of scrolls 18, 21 rotating on different axes to form a compression chamber A therebetween and discharging compressed gas in the compression chamber B to a discharge chamber, a pair of boss portions **16*b*, 17*b* immersed in lubricant oil for rotatably supporting the respective scrolls through bearing means, a first oil supply path 16*c*; 43 formed in one of the boss portions for communication with a bearing receiving recess 16*d*; 17*a* of the one boss portion, a second oil supply path 18*b*; 44, 45 formed in one of the scrolls on the side of the one boss portion for communication of the first oil supply path with the compression chamber through the recess, and a pump 33; 42** coupled to a shaft portion of the one scroll for supporting it rotatably within the bearing boss portions and for supplying oil in the discharge chamber to the first oil supply path.

2 Claims, 4 Drawing Sheets

ROTATING SCROLL MACHINE WITH OIL PUMP

BACKGROUND OF THE INVENTION

The present invention relates to a scroll machine of a full rotation type in which both a driving scroll and a driven scroll are rotated.

FIG. 5 is a cross section of a conventional scroll machine such as disclosed in Japanese Kokai No. 87693/1987, in which a reference numeral 1 depicts a casing, 2 a flange arranged in the casing 1 and having vertical oil return holes 2*a* and 3 a bearing support fixedly secured to the flange 2 and having a central, cylindrical boss portion 3*a*. A reference numeral 4 depicts a motor having a motor shaft 4*a* whose upper end is rotatably supported within the boss portion 3*a*. An eccentric hole 4*b* is formed in the upper end of the motor shaft 4*a* and an oil supply path 4*c* formed in the shaft 4*a* extends therealong to establish a communication from the eccentric hole 4*b* to the lower end of the shaft 4*a*. A reference numeral 5 depicts a driving scroll having a shaft 5*a* inserted into the eccentric hole 4*b*, 6 a stationary scroll coupled to the bearing support 3 to form, together with the driving scroll 5, a compression chamber 7, 8 a trochoid pump arranged between a lower surface 4*d* of the eccentric hole 4*b* and a lower end 5*b* of the shaft portion 5*a* and coupled to the latter. The trochoid pump has a suction port 4*e* formed in the bottom 4*d* of the eccentric hole 4*b* and a discharge port 5*c* formed in the lower end 5*b* of the shaft portion 5*a*. A reference numeral 9 depicts lubricant oil reserved in a bottom portion of the casing 1 in which the lower end of the motor shaft 4*a* is immersed A known anti-rotation mechanism 10 is provided for preventing rotation of the driving scroll 5. Reference numerals 13 and 15 depict a discharge port for discharging gas from the casing 1 and a suction port communicated with a space between the scrolls 5 and 6, respectively.

In operation, when the motor shaft 4*a* rotates, the driving scroll 5 orbits with respect to the stationary scroll 6, so that gas is taken in from the suction port 15, compressed by means of the relative movement of the stationary scroll 6 to the driving scroll and discharged through the discharge port 13 outside of the casing 1. With the rotation of the motor shaft 4*a* having the eccentric hole 4*b* in which the shaft portion 5*a* of the driving scroll 5 is received, the shaft portion 5*a* tends to rotate eccentrically together with the driving scroll 5. However, due to the presence of the anti-rotation mechanism 10 provided between the driving scroll 5 and the bearing support 3, the shaft portion 5*a* orbits. Therefore, the trochoid pump 8 disposed between the shaft portion 5*a* and the bottom 4*d* of the eccentric hole 4*b* performs a pump operation with an aid of an inner surface of the eccentric hole 4*b*, so that oil 9 is sent from the oil supply path 4*c* through the suction port 4*e* and the trochoid pump 8 to the discharge port 5*c* to lubricate sliding portions such as an outer periphery of the shaft portion 5*a* and the lower surface of the driving scroll 5 and, then returned through the oil return hole 2*a* to the bottom portion of the casing 1.

That is, in the conventional scroll machine, the oil pump portion is arranged at the upper end of the motor shaft and oil in the bottom portion of the casing has to be sucked up through the oil supply path formed in the motor shaft. Therefore, the length of the oil supply path becomes large, necessarily, causing fluid resistance in the suction side of pump to be large and the size of pump to become large.

SUMMARY OF THE INVENTION

The present invention is intended to solve the above mentioned problems and an object thereof is to provide a scroll machine whose sliding portions can be lubricated reliably with a pump of small capacity.

In order to achieve the above object, a scroll machine according to the present invention comprises a pair of scrolls capable of rotating on different axes to form a compression chamber therebetween and discharging compressed gas in the compression chamber to a discharge chamber, a pair of boss portions immersed in lubricant oil for rotatably supporting the respective scrolls through bearing means, a first oil supply path formed in one of the boss portions for communication with a bearing receiving recess of the one boss portion, a second oil supply path formed in one of the scrolls on the side of the one boss portion for communication of the first oil supply path with the compression chamber through the recess and a pump coupled to a shaft portion of the one scroll for supporting it rotatably within said bearing boss portions and for supplying oil in the discharge chamber to the first oil supply path.

In the scroll machine according to the present invention, oil around the boss portion is taken in directly by the rotary pump and supplied by the latter to the bearing portions and to the compression chamber within the scrolls. Therefore, the sliding portions of the machine can be lubricated reliably with the pump whose capacity is small enough.

DETAILED DESCRIPTION OF THE PREFERED EMBODIMENT

Figure 1:
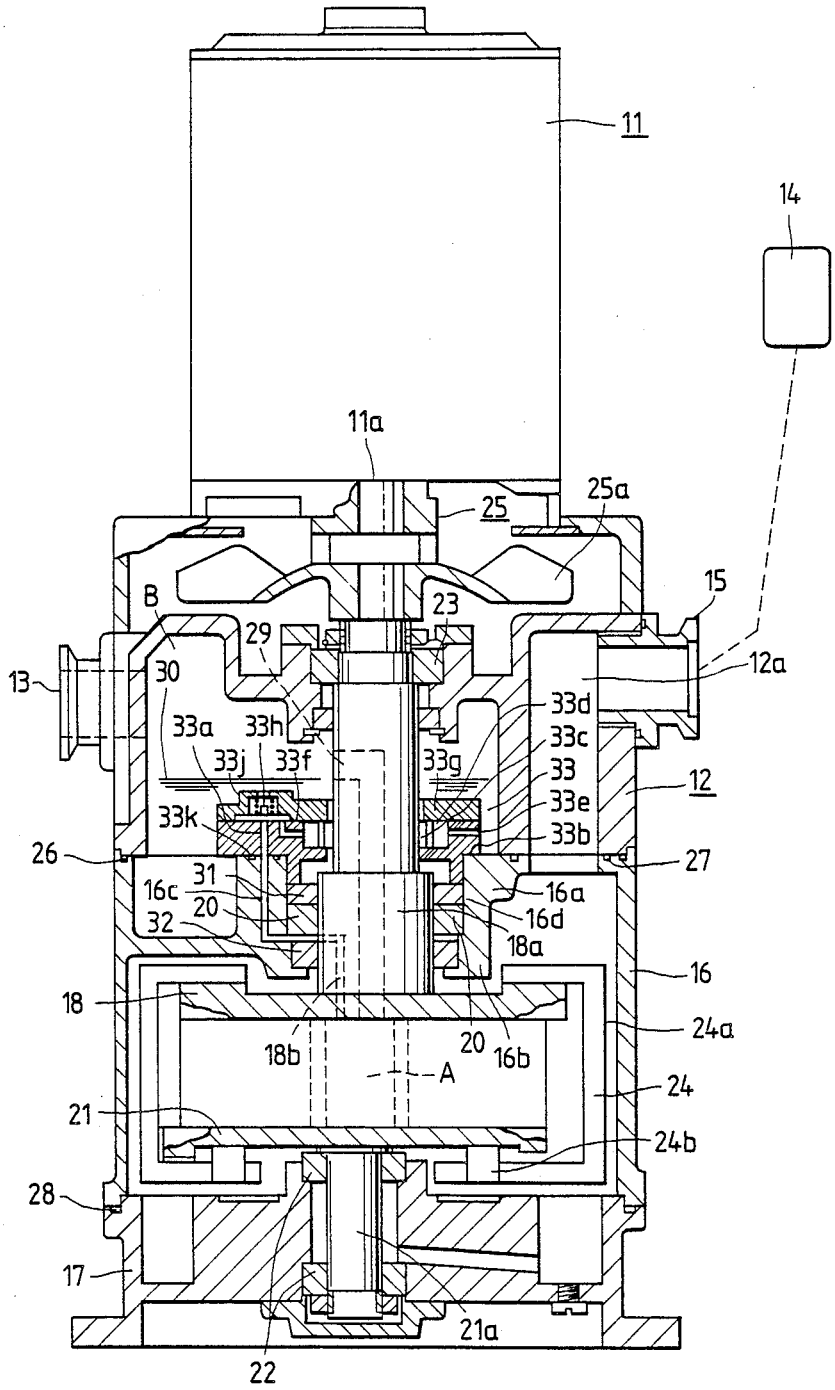
FIG. 1 is a cross sectional side view of an embodiment of the present invention.
Figure 3:
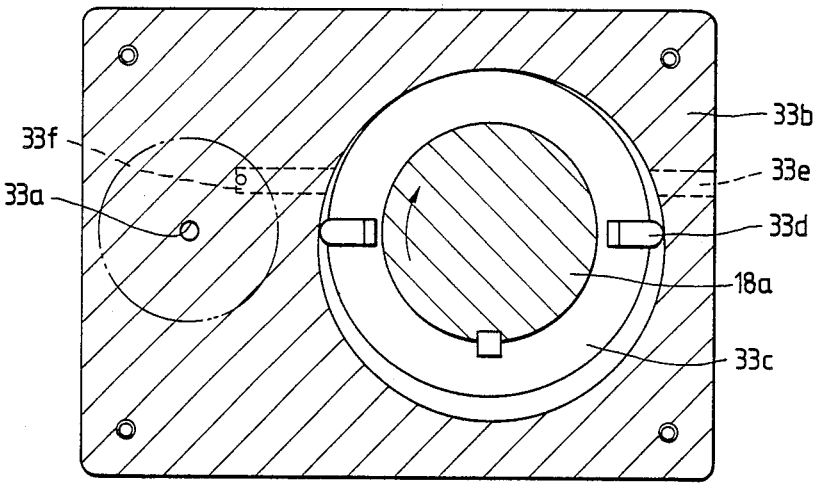
FIG. 3 is a cross section taken along a line III—III in FIG. 2.
Figure 2:
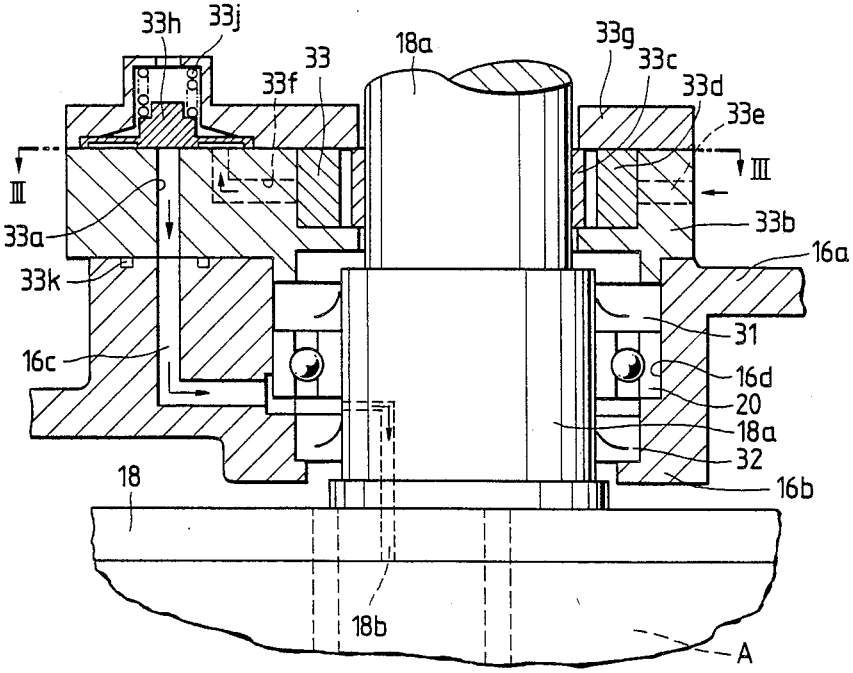
FIG. 2 is a cross section of a main portion of the present invention.

FIGS. 1 to 3 show an embodiment of the present invention in cross section. In these figures a rotary shaft 11*a* of a motor 11 fixedly mounted on an upper casing 12 which defines a discharge chamber B therein protrudes downward into the latter. The upper casing 12 is provided on one side of an upper portion thereof with a discharge port 13 and on the opposite side with a suction port 15 connected to a vacuum vessel 14.

A vertical suction passage 12*a* is provided in the upper casing 12. The suction passage 12*a* is isolated from an interior of the upper casing 12 and has an upper end connected to the suction port 15 and a lower end opened.

A lower casing 16 is connected to the lower end of the upper casing 12. The lower casing 16 has at an upper end thereof a bearing support 16*a* having a boss portion 16*b* in which an oil supply path 16*c* communicating with an interior of a bearing receiving portion 16*d* is formed. A lower cover 17 connected to a lower portion of the lower casing 16 is provided.

A driving scroll 18 is arranged within the lower casing 16. The driving scroll 18 has a shaft portion 18*a* protruding upwardly beyond the upper casing 12 and is supported rotatably through bearings 20 and 23 supported by the lower casing 16 and the upper casing 12, respectively.

An oil supply path 18*b* is formed along the shaft portion 18*a*, which communicates the interior of the bearing receiving portion 16*d* with a compression chamber A to be described.

A driven scroll 21 forms, together with the driving scroll 18, the compression chamber A. A shaft portion 21*a* of the driven scroll 21 is rotatably supported by bearings 22 supported by the lower cover 17 at a position eccentric with respect to the axis of the driving scroll 18.

An Oldham coupling 24 couples the driving scroll 18 to the driven scroll 21 such that they are rotatable with respect to each other. The Oldham coupling 24 is composed of an arm 24*a* coupled to the driving scroll 18 and a coupling 24*b* coupled to the driven scroll 21. A coupling 25 couples the rotary shaft 11*a* to the shaft portion 18*a* and is integral with a cooling fan 25*a*.

A sealing between the upper casing 12 and the lower casing 16 is provided by an O-ring 26 and a sealing between the suction passage 12*a* and the interior of the upper casing 12 is provided by an O-ring 27. An O-ring 28 is provided between the lower casing 16 and the lower cover 17.

A discharge path 29 is formed in the shaft portion 18*a* and has an upper opening positioned above an oil level 30.

Reference numerals 31 and 32 depict oil-seals for sealing between the upper casing 12 and the lower casing 16. A vane pump 33 is coupled to the bearing support 16*a*. The vane pump 33 is composed of a pump casing 33*b* having an oil supply path 33*a* connected to the oil supply path 16*c*, a rotor 33*c* fixed on the shaft portion 18*a*, a vane 33*d* fixed on the rotor 33*c*, a suction port 33*e* formed in the pump casing 33*b*, a discharge port 33*f* for oil, a pump cover 33*g* covering the pump casing 33*b*, a normally closed relief valve 33*h* for ON-OFF controlling the discharge port 33*f* and the oil supply port 33*a*, a biasing spring 33*j* for biasing the relief valve 33*h* and an O-ring 33*k* for sealing between the pump casing 33*b* and the boss portion 16*b*.

In operation, with rotation of the motor 11, the driving scroll 18 rotates, by which the driven scroll 21 is rotated eccentrically through the Oldham coupling 24. Therefore, gas is compressed between the scrolls 18 and 21 and discharged through the discharge path 29 into the upper casing 12. Consequently, gas in the vacuum vessel 14 is taken in the compression chamber between the scrolls 18 and 21 through the suction port 15, the suction path 12*a* and the lower casing 16 and, after being compressed, is discharged into the upper casing 12, similarly. Compressed gas within the upper casing 12 is discharged through the discharge port 13.

Lubrication oil within the lower casing 16 is taken in the chamber between the scrolls 18 and 21 to seal mutual sliding surfaces of them to each other to thereby prevent gas from leaking, and a portion of the lubricant is discharged, together with gas, through the discharge path 29 into the upper casing 12. Therefore, the amount of oil within the lower casing 16 is reduced gradually, resulting in degradation of gas sealing. In order to solve this problem, the vane pump 33 is provided. The vane pump 33 supplies oil in the upper casing 12 to the respective scrolls 18 and 21. That is, when the rotor 33*c* mounted on the shaft portion 18*a* of the driving scroll 18 rotates, oil existing around the suction port 33*e* is taken by the vane 33*d* and the pump casing 33*b* and discharged through the discharge port 33*f*. When the discharge pressure of the oil at the output of the discharge port 33*f* reaches a sufficient level, the relief valve 33*h* is raised against the spring 33*j*, so that the discharge port 33*f* is communicated with the oil supply path 33*a*. Therefore, oil is supplied through the oil supply path 33*a* and the oil supply path 16*c* to the bearing support recess 16*d* (see FIG. 2) and then to the compression chamber A between the scrolls 18 and 21 through the oil supply path 18*b*. Thus, a certain amount of oil is always kept reserved on the respective scrolls 18 and 21, so that gas leakage between the sliding surfaces of the scrolls is reliably prevented.

When the motor 11 stops rotating, there is no discharge pressure of the vane pump 33, so that the relief valve 33*h* is closed by the spring to prevent a reverse gas flow through the oil supply path 33*a*, 16*c* and 18*b*.

Figure 4:
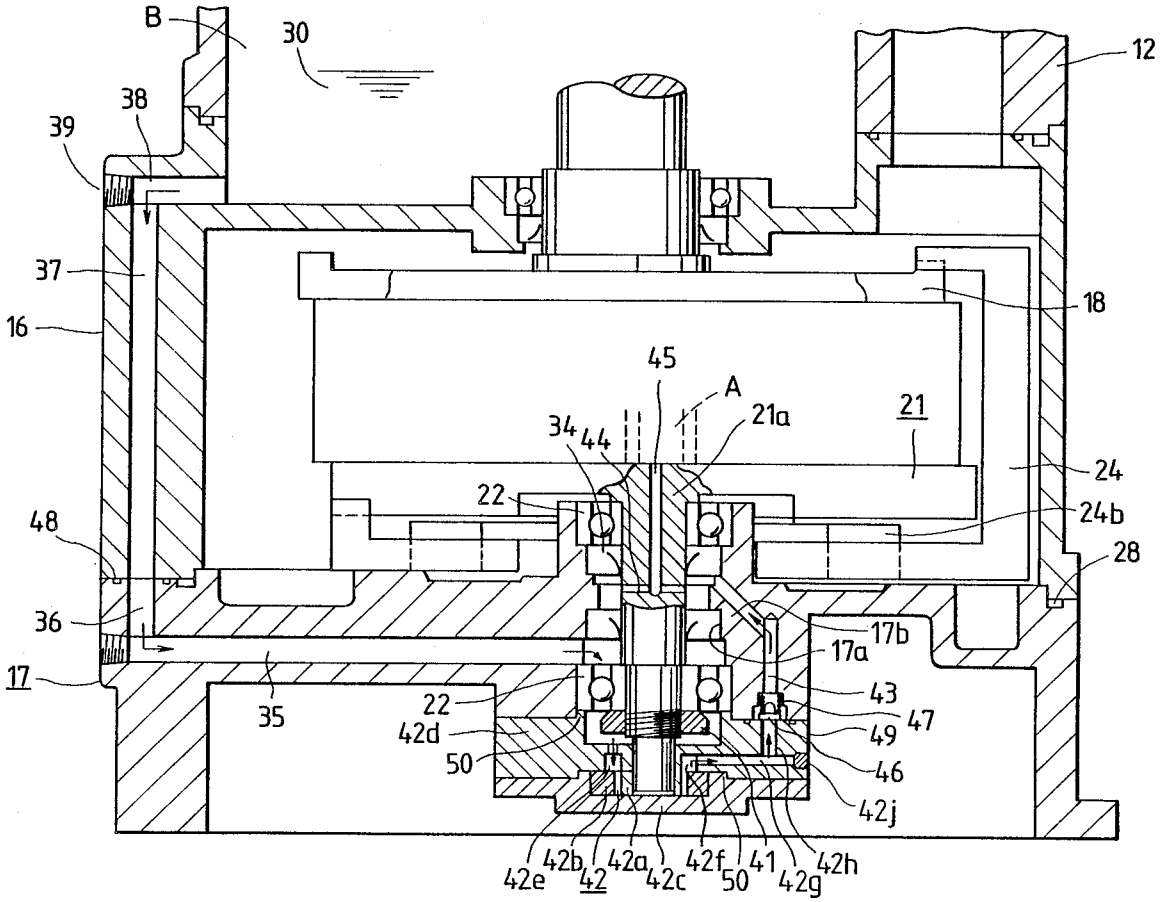
FIG. 4 is a cross section of a main portion of another embodiment the present invention.
Figure 5:
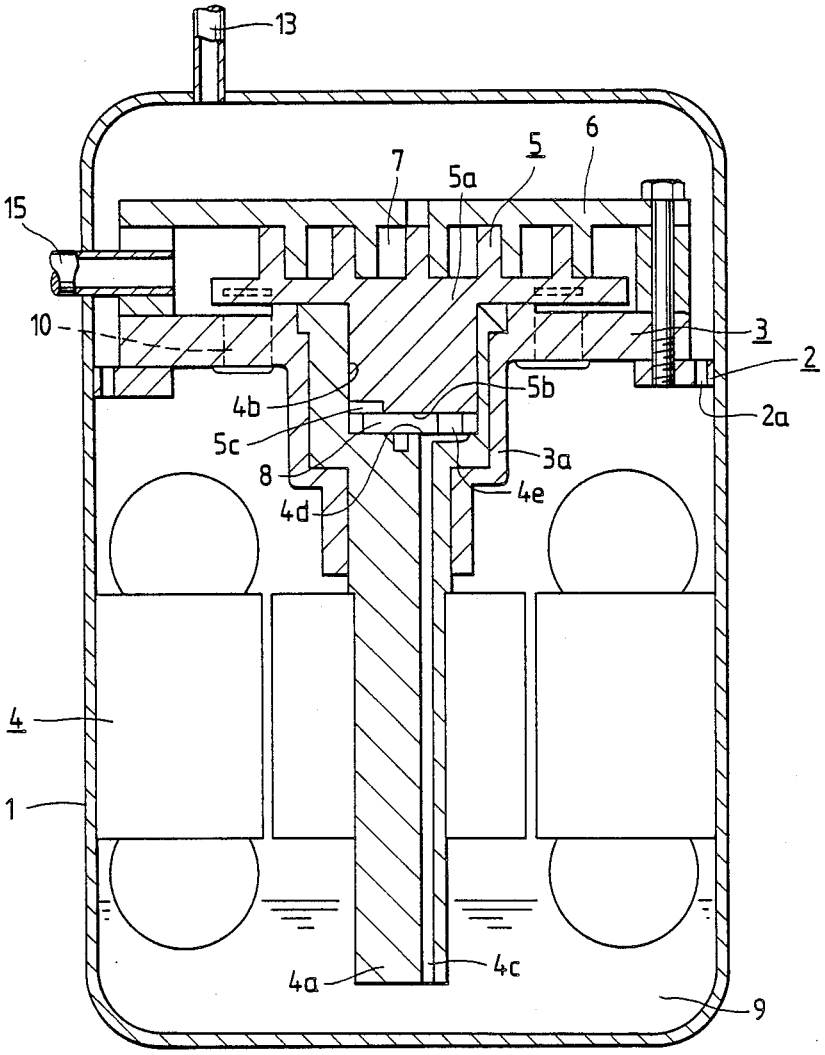
FIG. 5 PRIOR ART
FIG. 5 is a cross section of a conventional scroll machine.

FIG. 4 shows another embodiment of the present invention. In FIG. 4, the scroll machine includes a bearing journal 17*a* formed in a boss portion 17*b* of a lower cover 17. A pair of oil seals 34 are fitted on the bearing journal 17*a*, a horizontal oil supply path 35 is formed in the lower cover 17 and communicates with the bearing journal 17*a*, a vertical oil supply path 36 communicates with the oil supply path 35, a vertical oil supply path 37 formed in the lower casing 16, a horizontal oil supply path 38 communicates with the oil supply path 37, a plug 39 closes an opening of the oil supply path 38, nut 41 is provided on a shaft portion 21*a* of the driven scroll 21 for positioning the bearings 22, a vane pump 42 is coupled to a lower end of the shaft portion 21*a*, a vane 42*b* is fitted on a rotor 42*a* thereof, a pump casing 42*c* covers them, and a pump cover 42*d* is disposed between the pump casing 42*c* and the lower cover 17.

The pump cover 42*d* is provided with a suction port 42*e* communicating with an interior of the bearing journal 17*a*, a discharge port 42*f*, a horizontal oil supply path 42*g* communicating with the discharge port 42*f*, a vertical oil supply path 42*h* communicating with the oil supply path 42*g*, and a plug 42*j* closing an opening of the oil path 42*g*.

An oil path 43 is formed in the lower cover 17 for communication between the oil supply path 42*h* and the bearing journal 17*a*. The shaft portion 21*a* includes an oil path 44 extending longitudinally thereof to communicate with the oil path 43 through the bearing journal 17*a*, and a vertical oil path 45 for communicating the oil path 44 with the compression chamber A between the scrolls 18 and 21. A relief valve 46 ON-OFF controls a communication between the oil path 42*h* and the oil path 43, a spring 47 biases the relief valve 46, an O-ring 48 seals the oil path 37, an O-ring 49 seals the oil path 42*h*, and a pair of O-rings 50 seal the upper and lower ends of the pump cover 42*d*, respectively.

In this embodiment, oil is taken by the vane pump 42 through the oil paths 38, 37, 36 and 35, the bearing journal 17*a* and the suction port 42*e* and discharged from the discharge port 42*f*. The same oil is discharged through the oil paths 42*g*, 42*h* and 43 to the bearing journal 17*a* and, then, through the oil paths 44 and 45 to the compression chamber A between the scrolls 18 and 21.

Then, when the motor 11 stops rotating and, thus, the vane pump 42 is stopped, the relief valve 46 is closed by the spring 47 to prevent air from entering into the compression chamber A.

The vane pump 42 used in both embodiments may be replaced by any other pump such as a trochoid pump As mentioned hereinbefore, according to the present invention, a scroll machine comprises a pair of scrolls capable of rotating on different axes to form a compression chamber therebetween and discharging compressed gas in the compression chamber to a discharge chamber, a pair of boss portions immersed in lubricant oil for rotatably supporting the respective scrolls through bearing means, a first oil supply path formed in one of the boss portions for communiation with a bearing receiving recess of the one boss portion, a second oil supply path formed in one of the scrolls on the side of the one boss portion for communication of the first oil supply path with the compression chamber through said recess and a pump coupled to a shaft portion of the one scroll for supporting it rotatably within said bearing boss portions and for supplying oil in the discharge chamber to the first oil supply path. Therefore, the sliding portions of the machine can be lubricated reliably for a considerably long time with the pump whose capacity is small enough.

What is claimed is:

1. A scroll machine, comprising: a generally cylindrical, vertically oriented casing (12,16,17), a pair of scrolls (18,21) mounted for rotation within the casing on different axes to form a compression chamber (A) therebetween and discharging compressed gas in the compression chamber to a discharge chamber (b) defined in an upper portion (12) of the casing, a pair of vertically spaced boss portions (**16*b*,17*b*) extending inwardly of the casing for individually rotatably supporting said scrolls through bearing means, said boss portions being individually immersed in lubricant oil pools in said discharge and in a bottom portion of said casing, respectively, a first oil supply path (16*c*; 43) formed in one of said boss portions for communication with a bearing receiving recess (16*d*; 17*a*) of said one boss portion, a second oil supply path (18*b*; 44,45) formed in a shaft portion (18*a*; 21*a*) of one of said scrolls associated with said one boss portion for establishing a fluid communication path between said first oil supply path and said compression chamber through said recess, and a pump (33; 42**) coupled to said shaft portion of said one scroll for rotatable support within said one boss portion, said pump supplying oil in said discharge chamber to said compression chamber via said first oil supply path, said recess, and said second oil supply path.

2. The scroll machine as claimed in claim 1, further comprising a relief valve provided between a discharge port of said pump and said first oil supply path, said relief valve being opened by a discharge pressure at said discharge port.

* * * * *